US006524439B2

(12) United States Patent
Chen et al.

(10) Patent No.: US 6,524,439 B2
(45) Date of Patent: Feb. 25, 2003

(54) MANUFACTURE OF PAPER AND PAPERBOARD

(75) Inventors: Gordon Cheng I. Chen, Chesapeake, VA (US); Gary Peter Richardson, Bradford (GB)

(73) Assignee: Ciba Specialty Chemicals Water Treatments Ltd., Bradford (GB)

( * ) Notice: Subject to any disclaimer, the term of this patent is extended or adjusted under 35 U.S.C. 154(b) by 0 days.

(21) Appl. No.: 09/974,930

(22) Filed: Oct. 10, 2001

(65) Prior Publication Data

US 2002/0066540 A1 Jun. 6, 2002

Related U.S. Application Data

(60) Provisional application No. 60/240,635, filed on Oct. 16, 2000.

(51) Int. Cl.[7] ..... D21H 21/10

(52) U.S. Cl. ..... 162/168.1; 162/181.6; 162/181.8; 162/168.2; 162/168.3; 162/183

(58) Field of Search ..... 162/164.1, 168.1, 162/168.2, 168.3, 183, 181.1, 181.6, 181.8

(56) References Cited

U.S. PATENT DOCUMENTS

| | | | | |
|---|---|---|---|---|
| 4,021,364 A | | 5/1977 | Speiser et al. | 252/316 |
| 4,388,150 A | | 6/1983 | Sunden et al. | 162/175 |
| 4,521,317 A | | 6/1985 | Candau et al. | 252/8.55 |
| 4,681,912 A | | 7/1987 | Durand et al. | 524/827 |
| 5,167,766 A | * | 12/1992 | Honig et al. | 162/164.1 |
| 5,176,891 A | | 1/1993 | Rushmere | 423/328.1 |
| 5,393,381 A | | 2/1995 | Hund et al. | 162/168.3 |
| 5,431,783 A | * | 7/1995 | Honig | 162/168.2 |
| 5,482,693 A | | 1/1996 | Rushmere et al. | 423/328.1 |
| 5,501,774 A | * | 3/1996 | Burke | 162/181.67 |
| 5,584,966 A | | 12/1996 | Moffett | 162/168.1 |
| 5,676,796 A | * | 10/1997 | Cutts | 162/168.3 |
| 5,882,525 A | | 3/1999 | Neff et al. | 210/735 |
| 6,007,679 A | | 12/1999 | Nagarajan et al. | 162/168.3 |
| 6,103,064 A | * | 8/2000 | Asplund et al. | 162/181.6 |

FOREIGN PATENT DOCUMENTS

| | | |
|---|---|---|
| EP | 0235893 | 9/1987 |
| EP | 0308752 | 3/1989 |
| EP | 0335575 | 10/1989 |
| EP | 0462365 | 12/1991 |
| EP | 0484617 | 5/1992 |
| EP | 0485124 | 5/1992 |
| GB | 2161492 | 1/1986 |
| WO | 86/00100 | 1/1986 |
| WO | 97/33040 | 9/1997 |
| WO | 97/33041 | 9/1997 |
| WO | 98/29604 | 7/1998 |
| WO | 99/16708 | 4/1999 |
| WO | 01/34908 | 5/2001 |

OTHER PUBLICATIONS

S. Atik et al., J. Am. Chem. Soc. (1981), vol. 103, pp. 4279–4280.

Y. Huang et al., Makromol. Chem. vol. 186, pp. 273–281, (1985).

Stoffer et al., J. Dispersion Sci. and Tech., vol. 1, No. 1, (1980), p. 37.

* cited by examiner

*Primary Examiner*—Peter Chin
(74) *Attorney, Agent, or Firm*—David R. Crichton

(57) ABSTRACT

According to the present invention a process is provided for making paper or paper board comprising forming a cellulosic suspension, flocculating the suspension, draining the suspension on a screen to form a sheet and then drying the sheet, characterised in that the suspension is flocculated using a flocculation system comprising a siliceous material and organic microparticles which have an unswollen particle diameter of less than 750 nanometers.

27 Claims, 3 Drawing Sheets

MANUFACTURE OF PAPER AND PAPERBOARD

This application claims benefit of U.S. Provisioned Application No. 60/240,635 filed Oct. 16, 2000.

This invention relates to processes of making paper and paperboard from a cellulosic stock, employing a novel flocculating system.

During the manufacture of paper and paper board a cellulosic thin stock is drained on a moving screen (often referred to as a machine wire) to form a sheet which is then dried. It is well known to apply water soluble polymers to the cellulosic suspension in order to effect flocculation of the cellulosic solids and enhance drainage on the moving screen.

In order to increase output of paper many modern paper making machines operate at higher speeds. As a consequence of increased machine speeds a great deal of emphasis has been placed on drainage and retention systems that provide increased drainage. However, it is known that increasing the molecular weight of a polymeric retention aid which is added immediately prior to drainage will tend to increase the rate of drainage but damage formation. It is difficult to obtain the optimum balance of retention, drainage, drying and formation by adding a single polymeric retention aid and it is therefore common practice to add two separate materials in sequence.

EP-A-235893 provides a process wherein a water soluble substantially linear cationic polymer is applied to the paper making stock prior to a shear stage and then reflocculating by introducing bentonite after that shear stage. This process provides enhanced drainage and also good formation and retention. This process which is commercialised by Ciba Specialty Chemicals under the Hydrocol® trade mark has proved successful for more than a decade.

More recently there have been various attempts to provide variations on this theme by making minor modifications to one or more of the components.

U.S. Pat. No. 5,393,381 describes a process in which a process of making paper or board by adding a water soluble branched cationic polyacrylamide and a bentonite to the fibrous suspension of pulp. The branched cationic polyacrylamide is prepared by polymerising a mixture of acrylamide, cationic monomer, branching agent and chain transfer agent by solution polymerisation.

U.S. Pat. No. 5,882,525 describes a process in which a cationic branched water soluble polymer with a solubility quotient greater than about 30% is applied to a dispersion of suspended solids, e.g. a paper making stock, in order to release water. The cationic branched water soluble polymer is prepared from similar ingredients to U.S. Pat. No. 5,393,381 i.e. by polymerising a mixture of acrylamide, cationic monomer, branching agent and chain transfer agent.

In WO-A-9829604 a process of making paper is described in which a cationic polymeric retention aid is added to a cellulosic suspension to form flocs, mechanically degrading the flocs and then reflocculating the suspension by adding a solution of a second anionic polymeric retention aid. The anionic polymeric retention aid is a branched polymer which is characterised by having a rheological oscillation value of tan delta at 0.005 Hz of above 0.7 or by having a deionised SLV viscosity number which is at least three times the salted SLV viscosity number of the corresponding polymer made in the absence of branching agent. The process provided significant improvements in the combination of retention and formation by comparison to the earlier prior art processes.

EP-A-308752 describes a method of making paper in which a low molecular weight cationic organic polymer is added to the furnish and then a colloidal silica and a high molecular weight charged acrylamide copolymer of molecular weight at least 500,000. The description of the high molecular weight polymers indicates that they are linear polymers.

EP-A-462365 describes a method of making paper which comprises adding to an aqueous paper furnish ionic, organic microparticles which have an unswollen particle diameter of less than 750 nanometers if cross-linked and less than 60 nanometers if non-cross-linked and water-insoluble and have an anionicity of at least 1%, but at least 5% if cross-linked, anionic and used as the sole retention additive. The process is said to result in significant increase in fibre retention and improvements in drainage and formation.

EP-484617 describes a composition comprising cross-linked anionic or amphoteric, organic polymeric microparticles, said microparticles having an unswollen number average particle size diameter of less than 0.75 microns, a solution viscosity of at least 1.1 mPa.s and a cross-linking agent content of above 4 molar parts per million, based on the monomeric units and an ionicity of at least 5.0%. The polymers are described as being useful for a wide range of solid-liquid separation operations and specifically said to increase the drainage rates paper making.

However, there still exists a need to further enhance paper making processes by further improving drainage, retention and formation. Furthermore there also exists the need for providing a more effective flocculation system for making highly filled paper.

Figure 1:
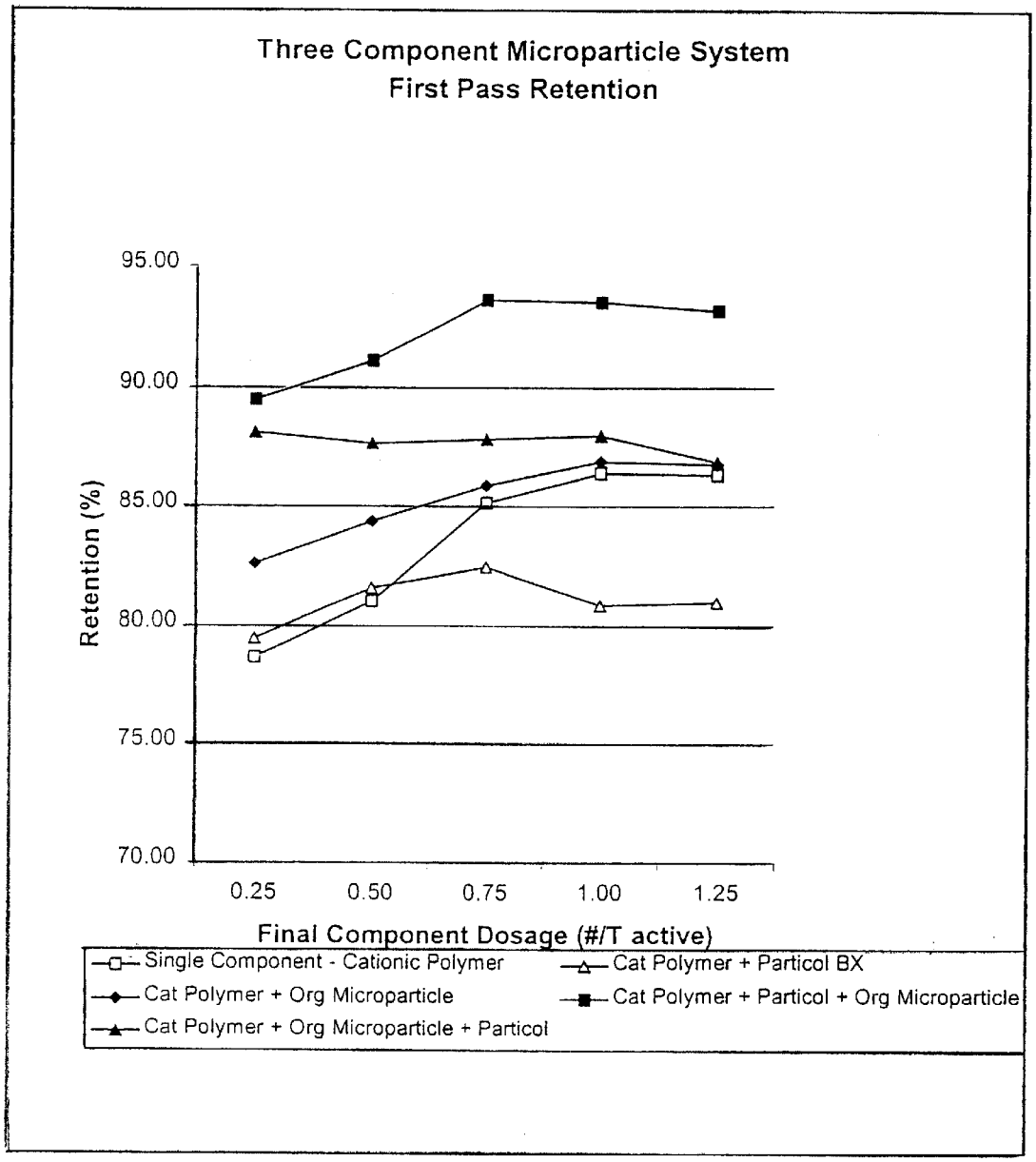
FIG. 1 is a graph retention versus dosage for various systems.

According to the present invention a process is provided for making paper or paper board comprising forming a cellulosic suspension, flocculating the suspension, draining the suspension on a screen to form a sheet and then drying the sheet, characterised in that the suspension is flocculated using a flocculation system comprising a siliceous material and organic microparticles which have an unswollen particle diameter of less than 750 nanometers.

The microparticles may be prepared according to any suitable technique documented in the literature. They may be prepared from a monomer blend that comprises water soluble ethylenically unsaturated monomers and polymerised by any suitable polymerisation technique that provides microparticles which have an unswollen particle diameter of less than 750 nanometers. The monomer blend may also comprise cross-linking agent. Generally the amount of crosslinking agent may be any suitable amount, for instance up to 50,000 ppm on a molar basis. Typically the amounts of cross-linking agent are in the range 1 to 5,000 ppm.

The microparticles may be prepared in accordance with the teachings of EP-A-484617. Desirably the microparticles exhibit a solution viscosity of at least 1.1 mPa.s and a cross-linking agent content of above 4 molar ppm based on monomeric units. Preferably the microparticles have an ionicity of at least 5.0% More preferably the microparticles are anionic.

In one form of the invention the microparticles are microbeads prepared in accordance with EP462365. The microbeads have a particle size of less than 750 nanometers if cross-linked and less than 60 nanometers if non-cross-linked and water-insoluble.

Preferably the microparticles exhibit a rheological oscillation value of tan delta at 0.005 Hz of below 0.7 based on 1.5% by weight polymer concentration in water. More preferably the tan delta value is below 0.5 and usually in the range 0.1 to 0.3.

It has surprisingly been found that flocculating the cellulosic suspension using a flocculation system that comprises a siliceous material and organic polymeric microparticles provides improvements in retention, drainage and formation by comparison to a system using the polymeric microparticles alone or the siliceous material in the absence of the polymeric microparticles.

The siliceous material may be any of the materials selected from the group consisting of silica based particles, silica microgels, colloidal silica, silica sols, silica gels, polysilicates, aluminosilicates, polyaluminosilicates, borosilicates, polyborosilicates, zeolites or swellable clay.

This siliceous material may be in the form of an anionic microparticulate material. Alternatively the siliceous material may be a cationic silica. Desirably the siliceous material may be selected from silicas and polysilicates. The silica may be for example any colloidal silica, for instance as described in WO-A-8600100. The polysilicate may be a colloidal silicic acid as described in U.S. Pat. No. 4,388,150.

The polysilicates of the invention may be prepared by acidifying an aqueous solution of an alkali metal silicate. For instance polysilicic microgels otherwise known as active silica may be prepared by partial acidification of alkali metal silicate to about pH 8–9 by use of mineral acids or acid exchange resins, acid salts and acid gases. It may be desired to age the freshly formed polysilicic acid in order to allow sufficient three dimensional network structure to form. Generally the time of ageing is insufficient for the polysilicic acid to gel. Particularly preferred siliceous material include polyalumino-silicates. The polyaluminosilicates may be for instance aluminated polysilicic acid, made by first forming polysilicic acid microparticles and then post treating with aluminium salts, for instance as described in U.S. Pat. No. 5,176,891. Such polyaluminosilicates consist of silicic microparticles with the aluminium located preferentially at the surface.

Alternatively the polyaluminosilicates may be polyparticulate polysicilic microgels of surface area in excess of 1000 $m^2/g$ formed by reacting an alkali metal silicate with acid and water soluble aluminium salts, for instance as described in U.S. Pat. No. 5,482,693. Typically the polyaluminosilicates may have a mole ratio of alumina:silica of between 1:10 and 1:1500.

Polyaluminosilicates may be formed by acidifying an aqueous solution of alkali metal silicate to pH 9 or 1 0 using concentrated sulphuric acid containing 1.5 to 2.0% by weight of a water soluble aluminium salt, for instance aluminium sulphate. The aqueous solution may be aged sufficiently for the three dimensional microgel to form. Typically the polyaluminosilicate is aged for up to about two and a half hours before diluting the aqueous polysilicate to 0.5 weight % of silica.

The siliceous material may be a colloidal borosilicate, for instance as described in WO-A-9916708. The colloidal borosilicate may be prepared by contacting a dilute aqueous solution of an alkali metal silicate with a cation exchange resin to produce a silicic acid and then forming a heel by mixing together a dilute aqueous solution of an alkali metal borate with an alkali metal hydroxide to form an aqueous solution containing 0.01 to 30% $B_2O_3$, having a pH of from 7 to 10.5.

The swellable clays may for instance be typically a bentonite type clay. The preferred clays are swellable in water and include clays which are naturally water swellable or clays which can be modified, for instance by ion exchange to render them water swellable. Suitable water swellable clays include but are not limited to clays often referred to as hectorite, smectites, montmorillonites, nontronites, saponite, sauconite, hormites, attapulgites and sepiolites. Typical anionic swelling clays are described in EP-A-235893 and EP-A-335575.

Most preferably the clay is a bentonite type clay. The bentonite may be provided as an alkali metal bentonite. Bentonites occur naturally either as alkaline bentonites, such as sodium bentonite or as the alkaline earth metal salt, usually the calcium or magnesium salt. Generally the alkaline earth metal bentonites are activated by treatment with sodium carbonate or sodium bicarbonate. Activated swellable bentonite clay is often supplied to the paper mill as dry powder. Alternatively the bentonite may be provided as a high solids flowable slurry , for example at least 15 or 20% solids, for instance as described in EP-A485124, WO-A-9733040 and WO-A-9733041.

The microparticles may be made as microemulsions by a process employing an aqueous solution comprising a cationic or anionic monomer and crosslinking agent; an oil comprising a saturated hydrocarbon; and an effective amount of a surfactant sufficient to produce particles of less than about 0.75 micron in unswollen number average particle size diameter. Microbeads are also made as microgels by procedures described by Ying Huang et. al., Makromol. Chem. 186, 273–281 (1985) or may be obtained commercially as microlatices. The term "microparticle", as used herein, is meant to include all of these configurations, i.e. beads per se, microgels and microlatices.

Polymerisation of the emulsion to provide microparticles may be carried out by adding a polymerization initiator, or by subjecting the emulsion to ultraviolet radiation. An effective amount of a chain transfer agent may be added to the aqueous solution of the emulsion, so as to control the polymerization. It was surprisingly found that the crosslinked, organic, polymeric microparticles have a high efficiency as retention and drainage aids when their particle size is less than about 750 nm in diameter and preferably less than about 300 nm in diameter and that the noncrosslinked, organic, water-insoluble polymer microparticles have a high efficiency when their size is less than about 60 nm. The efficiency of the crosslinked microparticles at a larger size than the noncrosslinked microparticles may be attributed to the small strands or tails that protrude from the main crosslinked polymer.

Cationic microparticles used herein include those made by polymerizing such monomers as diallyldialkylammmonium halides; acryloxyalkyltrimethylammonium chloride; (meth)acrylates of dialkylaminoalkyl compounds, and salts and quaternaries thereof and, monomers of N,N-dialkylaminoalkyl(meth)acrylamides, and salt and quaternaries thereof, such as N,N-dimethyl aminoethylacrylamides; (meth)acrylamidopropyltrimethylammonium chloride and the acid or quaternary salts of N,N-dimethylaminoethylacrylate and the like. Cationic monomers which may be used herein are of the following general formulae:

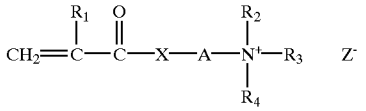

where $R_1$ is hydrogen or methyl, $R_2$ is hydrogen or lower alkyl of $C_1$ to $C_4$, $R_3$ and/or $R_4$ are hydrogen, alkyl of $C_1$ to $C_{12}$, aryl, or hydroxyethyl and $R_2$ and $R_3$ or $R_2$ and $R_4$ can combined to form a cyclic ring containing one or more hetero atoms, Z is the conjugate base of an acid, X is oxygen or —$NR_1$ wherein $R_1$ is as defined above, and A is an alkylene group of $C_1$ to $C_{12}$; or

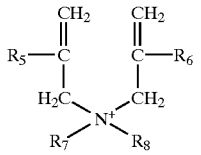

where $R_5$ and $R_6$ are hydrogen or methyl, $R_7$ is hydrogen or alkyl of $C_1$ to $C_{12}$ and $R_8$ is hydrogen, alkyl of $C_1$ to $C_{12}$, benzyl or hydroxyethyl; and Z is as defined above.

Anionic microparticles that are useful herein those made by hydrolyzing acrylamide polymer microparticles etc. those made by polymerizing such monomers as (methyl) acrylic acid and their salts, 2-acrylamido-2-methylpropane sulfonate, sulfoethyl-(meth)acrylate, vinyisulfonic acid, styrene sulfonic acid, maleic or other dibasic acids or their salts or mixtures thereof.

Nonionic monomers, suitable for making microparticles as copolymers with the above anionic and cationic monomers, or mixtures thereof, include (meth)acrylamide; N-alkyacrylamides, such as N-methylacrylamide; N,N-dialkylacrylamides, such as N,N-dimethylacrylamide; methyl acrylate; methyl methacrylate; acrylonitrile; N-vinyl methylacetamide; N-vinyl methyl formamide; vinyl acetate; N-vinyl pyrrolidone, mixtures of any of the foregoing and the like.

These ethylenically unsaturated, non-ionic monomers may be copolymerized, as mentioned above, to produce cationic, anionic or amphoteric copolymers. Preferably, acrylamide is copolymerized with an ionic and/or cationic monomer. Cationic or anionic copolymers useful in making microparticies comprise from about 0 to about 99 parts, by weight, of non-ionic monomer and from about 100 to about 1 part, by weight, of cationic or anionic monomer, based on the total weight of the anionic or cationic and non-ionic monomers, preferably from about 10 to about 90 parts, by weight, of non-ionic monomer and about 10 to about 90 parts, by weight, of cationic or anionic monomer, same basis i.e. the total ionic charge in the microparticle must be greater than about 1%. Mixtures of polymeric microparticles may also be used if the total ionic charge of the mixture is also over about 1%. Most preferably, the microparticles contain from about 20 to 80 parts, by weight, of non-ionic monomer and about 80 to about 20 parts by weight, same basis, of cationic or anionic monomer or mixture thereof. Polymerization of the monomers occurs in the presence of a polyfunctional crosslinking agent to form the cross-linked microparticle. Useful polyfunctional crosslinking agents comprise compounds having either at least two double bounds, a double bond and a reactive group, or two reactive groups. Illustrative of those containing at least two double bounds are N,N-methylenebisacrylamide; N,N-methylenebismethacrylamide; polyethyleneglycol diacrylate; polyethyleneglycol dimethacrylate; N-vinyl acrylamide; divinylbenzene; triallylammonium salts, N-methylallylacrylamide and the like. Polyfunctional branching agents containing at least one double bond and at least one reactive group include glycidyl acrylate; glycidyl methacrylate; acrolein; methylolacrylamide and the like. Polyfunctional branching agents containing at least two reactive groups include dialdehydes, such as gyloxal; diepoxy compounds; epichlorohydrin and the like.

Crosslinking agents are to be used in sufficient quantities to assure a cross-linked composition. Preferably, at least about 4 molar parts per million of crosslinking agent based on the monomeric units present in the polymer are employed to induce sufficient crosslinking and especially preferred is a crosslinking agent content of from about 4 to about 6000 molar parts per million, preferably, about 20–4000. More preferably the amount of crosslinking agents used is in excess of 60 or 70 molar ppm. The amounts particularly preferred are in excess of 100 or 150 ppm, especially in the range 200 to 1000 ppm. Most preferably the amount of cross-linking agents is in the range 350 to 750 ppm.

The polymeric microparticles of this invention are preferably prepared by polymerization of the monomers in an emulsion as disclosed in application, EP-484617. Polymerization in microemulsions and inverse emulsions may be used as is known to those skilled in this art. P. Speiser reported in 1976 and 1977 a process for making spherical "nanoparticles" with diameters less than 800 Ångstrom by (1) solubilizing monomers, such as acrylamide and methylenebisacrylamide, in micelles and (2) polymerizing the monomers, See J. Pharm. Sa., 65(12), 1763 (1976) and U.S. Pat. No. 4,021,364. Both inverse water-in-oil and oil-in-water "nanoparticles" were prepared by this process. While not specifically called microemulsion polymerization by the author, this process does contain all the features which are currently used to define microemulsion polymerization. These reports also constitute the first examples of polymerization of acrylamide in a microemulsion. Since then, numerous publications reporting polymerization of hydrophobic monomers in the oil phase of microemulsions have appeared. See, for examples, U.S. Pat. Nos. 4,521,317 and 4,681,912; Stoffer and Bone, J. Dispersion Sci. and Tech., 1(1), 37, 1980; and Atik and Thomas, J. Am. Chem. Soc., 103 (14), 4279 (1981); and GB 2161492A.

The cationic and/or anionic emulsion polymerization process is conducted by (i) preparing a monomer emulsion by adding an aqueous solution of the monomers to a hydrocarbon liquid containing appropriate surfactant or surfactant mixture to form an inverse monomer emulsion consisting of small aqueous droplets which, when polymerized, result in polymer particles of less than 0.75 micron in size, dispersed in the continuous oil phase and (ii) subjecting the monomer microemulsion to free radical polymerization.

The aqueous phase comprises an aqueous mixture of the cationic and/or anionic monomers and optionally, a non-ionic monomer and the crosslinking agent, as discussed above. The aqueous monomer mixture may also comprise such conventional additives as are desired. For example, the mixture may contain chelating agents to remove polymerization inhibitors, pH adjusters, initiators and other conventional additives.

Essential to the formation of the emulsion, which may be defined as a swollen, transparent and thermodynamically stable emulsion comprising two liquids insoluble in each other and a surfactant, in which the micelles are less than 0.75 micron in diameter, is the selection of appropriate organic phase and surfactant.

The selection of the organic phase has a substantial effect on the minimum surfactant concentration necessary to obtain the inverse emulsion. The organic phase may comprise a hydrocarbon or hydrocarbon mixture. Saturated hydrocarbons or mixtures thereof are the most suitable in order to obtain inexpensive formulations. Typically, the organic phase will comprise benzene, toluene, fuel oil, kerosene, odorless mineral spirits or mixtures of any of the foregoing.

The ratio, by weight, of the amounts of aqueous and hydrocarbon phases is chosen as high as possible, so as to obtain, after polymerization, an emulsion of high polymer content. Practically, this ratio may range, for example for about 0.5 to about 3:1, and usually approximates about 1:1, respectively.

One or more surfactants may be selected in order to obtain HLB (Hydrophilic Lipophilic Balance) value ranging from about 8 to about 11. In addition to the appropriate HLB value, the concentration of surfactant must also be optimized, i.e. sufficient to form an inverse emulsion. Too low a concentration of surfactant leads to inverse emulsions of the prior art and too high a concentrations results in undue costs. Typical surfactants useful, in addition to those specifically discussed above, may be anionic, cationic or non-ionic and may be selected from polyoxyethylene (20) sorbitan trioleate, sorbitan trioleate, sodium di-2-ethylhexylsulfosuccinate, oleamidopropyidimethylamine; sodium isostearyl-2-lactate and the like. Polymerization of the emulsion may be carried out in any manner known to those skilled in the art. Initiation may be effected with a variety of thermal and redox free-radical initiators including azo compounds, such as azobisisobutyronitrile; peroxides, such as t-butyl peroxide; inorganic compounds, such as potassium persulfate and redox couples, such as ferrous ammonium sulfate/ammonium persulfate. Polymerization may also be effected by photochemical irradiation processes, irradiation, or by ionizing radiation with a $Co^{60}$ source. Preparation of an aqueous product from the emulsion may be effected by inversion by adding it to water which may contain a breaker surfactant. Optionally, the polymer may be recovered from the emulsion by stripping or by adding the emulsion to a solvent which precipitates the polymer, e.g. isopropanol, filtering off the resultant solids, drying and redispersing in water.

The high molecular weight, ionic, synthetic polymers used in the present invention preferably have a molecular weight in excess of 100,000 and preferably between about 250,000 and 25,000,000. Their anionicity and/or cationicity may range from 1 mole percent to 100 mole percent. The ionic polymer may also comprise homopolymers or copolymers of any of the ionic monomers discussed above with regard to the ionic beads, with acrylamide copolymers being preferred.

The tan delta at 0.005 Hz value is obtained using a Controlled Stress Rheometer in Oscillation mode on a 1.5% by weight aqueous solution of polymer in deionised water after tumbling for two hours. In the course of this work a Carrimed CSR 100 is used fitted with a 6 cm acrylic cone, with a 1° 58' cone angle and a 58 $\mu$m truncation value (Item ref 5664). A sample volume of approximately 2–3 cc is used. Temperature is controlled at 20.0° C.±0.1° C. using the Peltier Plate. An angular displacement of $5\pm10^{-4}$ radians is employed over a frequency sweep from 0.005 Hz to 1 Hz in 12 stages on a logarithmic basis. G' and G" measurements are recorded and used to calculate tan delta (G"/G') values. The value of tan delta is the ratio of the loss (viscous) modulus G" to storage (elastic) modulus G' within the system.

At low frequencies (0.005 Hz) it is believed that the rate of deformation of the sample is sufficiently slow to enable linear or branched entangled chains to disentangle. Network or cross-linked systems have permanent entanglement of the chains and show low values of tan delta across a wide range of frequencies, Therefore low frequency (e.g. 0.005 Hz) measurements are used to characterise the polymer properties in the aqueous environment.

According to the invention the components of the flocculation system may be combined into a mixture and introduced into the cellulosic suspension as a single composition. Alternatively the polymeric microparticles and the siliceous material may be introduced separately but simultaneously. Preferably, however, the siliceous material and the polymeric microparticles are introduced sequentially more preferably when the siliceous material is introduced into the suspension and then the polymeric microparticles.

In a preferred form of the invention the process comprises including a further flocculating material into the cellulosic suspension before adding the polymeric microparticles and siliceous material. The further flocculating material may be anionic, non-ionic or cationic. It may be for instance a synthetic or natural polymer and may be a water soluble substantially linear or branched polymer. Alternatively the first flocculating material is a cross-linked polymer or a blend of cross-linked and water soluble polymer. In a preferred form of the invention the polymeric microparticles and siliceous material are added to the cellulosic suspension, which suspension has been pre-treated with a cationic material. The cationic pre-treatment may be by incorporating cationic materials into the suspension at any point prior to the addition of the polymeric microparticle and siliceous material.

Thus the cationic treatment may be immediately before adding the polymeric microparticle and siliceous material although preferably the cationic material is introduced into the suspension sufficiently early in order for it to be distributed throughout the cellulosic suspension before either the polymeric microparticle or siliceous material are added. It may be desirable to add the cationic material before one of the mixing, screening or cleaning stages and in some instances before the stock suspension is diluted. It may even be beneficial to add the cationic material into the mixing chest or blend chest or even into one or more of the components of the cellulosic suspension, for instance, coated broke or filler suspensions for instance precipitated calcium carbonate slurries.

The cationic material may be any number of cationic species such as water soluble cationic organic polymers, or inorganic materials such as alum, polyaluminium chloride, aluminium chloride trihydrate and aluminochloro hydrate. The water soluble cationic organic polymers may be natural polymers, such as cationic starch or synthetic cationic polymers. Particularly preferred are cationic materials that coagulate or flocculate the cellulosic fibres and other components of the cellulosic suspension.

According to another preferred aspect of the invention the flocculation system comprises at least three flocculent components. Thus this preferred system employs polymeric microparticles, siliceous material and at least one additional flocculant/coagulant.

The additional flocculant/coagulant component is preferably added prior to either the siliceous material or polymeric microparticle. Typically the additional flocculent is a natural or synthetic polymer or other material capable of causing flocculation/coagulation of the fibres and other components of the cellulosic suspension. The additional flocculant/ coagulant may be a cationic, non-ionic, anionic or amphoteric natural or synthetic polymer. It may be a natural polymer such as natural starch, cationic starch, anionic starch or amphoteric starch. Alternatively it may be any water soluble synthetic polymer which preferably exhibits ionic character. The preferred ionic water soluble polymers have cationic or potentially cationic functionality. For instance the cationic polymer may comprise free amine groups which become cationic once introduced into a cellulosic suspension with a sufficiently low pH so as to protonate free amine groups. Preferably however, the cationic polymers carry a permanent cationic charge, such as quaternary ammonium groups.

The additional flocculant/coagulant may be used in addition to the cationic pre-treatment step described above. In a particularly preferred system the cationic pre-treatment is also the additional flocculant/coagulant. Thus this preferred process comprises adding a cationic flocculant/coagulant to the cellulosic suspension or to one or more of the suspension components thereof, in order to cationically pre-treat the cellulosic suspension. The suspension is susbsequently subjected to further flocculation stages comprising addition of the polymeric microparticles and the siliceous material.

The cationic flocculant/coagulant is desirably a water soluble polymer which may for instance be a relatively low molecular weight polymer of relatively high cationicity. For instance the polymer may be a homopolymer of any suitable ethylenically unsaturated cationic monomer polymerised to provide a polymer with an intrinsic viscosity of up to 3 dl/g. Homopolymers of diallyl dimethyl ammonium chloride are preferred. The low molecular weight high cationicity polymer may be an addition polymer formed by condensation of amines with other suitable di- or tri-functional species. For instance the polymer may be formed by reacting one or more amines selected from dimethyl amine, trimethyl amine and ethylene diamine etc and epihalohydrin, epichlorohydrin being preferred. Preferably the cationic flocculant/coagulant is a polymer that has been formed from a water soluble ethylenically unsaturated cationic monomer or blend of monomers wherein at least one of the monomers in the blend is cationic or potentially cationic. By water soluble we mean that the monomer has a solubility in water of at least 5 g/100 cc. The cationic monomer is preferably selected from di allyl di alkyl ammonium chlorides, acid addition salts or quaternary ammonium salts of either dialkyl amino alkyl (meth) acrylate or dialkyl amino alkyl (meth) acrylamides. The cationic monomer may be polymerised alone or copolymerised with water soluble non-ionic, cationic or anionic monomers. More preferably such polymers have an intrinsic viscosity of at least 3 dl/g, for instance as high as 16 or 18 dl/g, but usually in the range 7 or 8 to 14 or 15 dl/g.

Particularly preferred cationic polymers include copolymers of methyl chloride quaternary ammonium salts of dimethylaminoethyl acrylate or methacrylate. The water soluble cationic polymer may be a polymer with a Theological oscillation value of tan delta at 0.005 Hz of above 1.1 (defined by the method given herein) for instance as provided for in copending patent application based on the priority U.S. patent application Ser. No. 60/164,231 (reference PP/W-21916/P1/AC 526).

The water soluble cationic polymer may also have a slightly branched structure for instance by incorporating small amounts of branching agent e.g. up to 20 ppm by weight. Such branched polymers may also be prepared by including a chain transfer agent into the monomer mix. The chain transfer agent may be included in an amount of at least 2 ppm by weight and may be included in an amount of up to 200 ppm by weight. Typically the amounts of chain transfer agent are in the range 10 to 50 ppm by weight. The chain transfer agent may be any suitable chemical substance, for instance sodium hypophosphite, 2-mercaptoethanol, malic acid or thioglycolic acid.

When the flocculation system comprises cationic polymer, it is generally added in an amount sufficient to effect flocculation. Usually the dose of cationic polymer would be above 20 ppm by weight of cationic polymer based on dry weight of suspension. Preferably the cationic polymer is added in an amount of at least 50 ppm by weight for instance 100 to 2000 ppm by weight. Typically the polymer dose may be 150 ppm to 600 ppm by weight, especially between 200 and 400 ppm.

Typically the amount of polymeric microparticle may be at least 20 ppm by weight based on weight of dry suspension, although preferably is at least 50 ppm by weight, particularly between 100 and 2000 ppm by weight. Doses of between 150 and 600 ppm by weight are more preferred, especially between 200 and 400 ppm by weight. The siliceous material may be added at a dose of at least 100 ppm by weight based on dry weight of suspension. Desirably the dose of siliceous material may be in the range of 500 or 750 ppm to 10,000 ppm by weight. Doses of 1000 to 2000 ppm by weight siliceous material have been found to be most effective.

In one preferred form of the invention the cellulosic suspension is subjected to mechanical shear following addition of at least one of the components of the flocculating system. Thus in this preferred form at least one component of the flocculating system is mixed into the cellulosic suspension causing flocculation and the flocculated suspension is then mechanically sheared. This shearing step may be achieved by passing the flocculated suspension through one or more shear stages, selected from pumping, cleaning or mixing stages. For instance such shearing stages include fan pumps and centri-screens, but could be any other stage in the process where shearing of the suspension occurs.

The mechanical shearing step desirably acts upon the flocculated suspension in such a way as to degrade the flocs. All of the components of the flocculating system may be added prior to a shear stage although preferably at least the last component of the flocculating system is added to the cellulosic suspension at a point in the process where there is no substantial shearing before draining to form the sheet. Thus it is preferred that at least one component of the flocculating system is added to the cellulosic suspension and the flocculated suspension is then subjected to mechanical shear wherein the flocs are mechanically degraded and then at least one component of the flocculating system is added to reflocculate the suspension prior to draining.

According to a more preferred form of the invention the water-soluble cationic polymer is added to the cellulosic suspension and then the suspension is then mechanically sheared. The siliceous material and the polymeric microparticle are then added to the suspension. The polymeric microparticle and siliceous material may be added either as a premixed composition or separately but simultaneously but preferably they are added sequentially. Thus the suspension may be re-flocculated by addition of the polymeric microparticles followed by the siliceous material but preferably the suspension is reflocculated by adding siliceous material and then the polymeric microparticles.

The first component of the flocculating system may be added to the cellulosic suspension and then the flocculated suspension may be passed through one or more shear stages. The second component of the flocculation system may be added to re-flocculate the suspension, which re-flocculated suspension may then be subjected to further mechanical shearing. The sheared reflocculated suspension may also be further flocculated by addition of a third component of the flocculation system. In the case where the addition of the components of the flocculation system is separated by shear stages it is preferred that the polymeric microparticle component is the last component to be added.

In another form of the invention the suspension may not be subjected to any substantial shearing after addition of any of the components of the flocculation system to the cellulosic suspension. The siliceous material, polymeric microparticle and where included the water soluble cationic polymer may all be introduced into the cellulosic suspension after the last shear stage prior to draining. In this form of the invention the polymeric microparticle may be the first component followed by either the cationic polymer (if included) and then the siliceous material. However, other orders of addition may also be used.

In a further preferred form of the invention we provide a process of making paper or board in which the a cationic material is introduced into the furnish or components thereof and the treated furnish is passed through at least one shear stage selected from mixing, cleaning and screening stages and then the furnish is subjected to flocculation by a flocculation system comprising anionic polymeric microparticles and a siliceous material. As given before the anionic polymeric microparticles and siliceous material may be added simultaneously or added sequentially. When added sequentially there may be a shear stage between the addition points.

A particularly preferred process employs the organic microparticle as the major component of the total flocculation system comprising a siliceous material and organic microparticles. Hence the organic microparticle should in this case be greater than 50%, preferably greater than 55% of the total flocculation system. In this form of the invention it is highly desirable that the ratio of organic microparticles to siliceous material is in the range 55:45 and 99:1 based on weight of materials. Preferably the ratio of organic microparticle to siliceous material is between 60:40 and 90:10, more preferably between 65:35 and 80:20, especially about 75:25.

In one preferred form of the invention we provide a process of preparing paper from a cellulosic stock suspension comprising filler. The filler may be any of the traditionally used filler materials. For instance the filler may be clay such as kaolin, or the filler may be a calcium carbonate which could be ground calcium carbonate or in particular precipitated calcium carbonate, or it may be preferred to use titanium dioxide as the filler material. Examples of other filler materials also include synthetic polymeric fillers. Generally a cellulosic stock comprising substantial quantities of filler are more difficult to flocculate. This is particularly true of fillers of very fine particle size, such as precipitated calcium carbonate.

Thus according to a preferred aspect of the present invention we provide a process for making filled paper. The paper making stock may comprise any suitable amount of filler. Generally the cellulosic suspension comprises at least 5% by weight filler material. Typically the amount of filler will be up to 40%, preferably between 10% and 40% filler. Thus according to this preferred aspect of this invention we provide a process for making filled paper or paper board wherein we first provide a cellulosic suspension comprising filler and in which the suspension solids are flocculated by introducing into the suspension a flocculating system comprising a siliceous material and polymeric microparticle as defined herein.

In an alternative form of the invention we provide a process of preparing paper or paperboard from a cellulosic stock suspension which is substantially free of filler.

As an illustration of the invention a cellulosic stock is prepared containing a 50/50 bleached birch/bleached pine suspension containing 40% by weight (on total solids) precipitated calcium carbonate. The stock suspension is beaten to a freeness of 55° (Schopper Riegler method) before the addition of filler. 5 kg per tonne (on total solids) cationic starch (0.045 DS) is added to the suspension.

500 grams per tonne of copolymer of acrylamide with methyl chloride quaternary ammonium salt of dimethylaminoethyl acrylate (75/25 wt./wt.) of intrinsic viscosity above 11.0 dl/g is mixed with the stock and then after shearing the stock using a mechanical stirrer then 250 grams per tonne of a polymeric microparticle comprising anionic copolymer of acrylamide with sodium acrylate (65/35) (wt./wt.) with 700 ppm by weight methylene bis acrylamide prepared by microemulsion polymerisation as given herein is mixed into the stock. 2000 grams per tonne of an aqueous colloidal silica is applied after the shearing but immediately prior to the addition of polymeric microparticle.

We find that for doses that provide equivalent drainage and/or retention the combination of both microparticle and silica gives improved formation over the separate use of microparticle or silica.

The following Example further illustrate the invention without in any way being intended to limit the invention.

EXAMPLE 1

A model fine paper stock is prepared containing a fibre content comprising equal mix of bleached birch and bleached pine and contained 40%, by weight (PCC on dry fibre), precipitated calcium carbonate (Albacar HO, Specialty Minerals Inc). The stock is used at a 1% paper stock concentration.

The following ADDITIVES are used in the evaluation

CATIONIC POLYMER=High molecular copolymer of acrylamide with dimethylaminethyl acrylate, methyl chloride quaternary ammonium salt (60/40 weight/weight) then made up as a 0.1% solution.

ORGANIC-MICROPARTICLE=Anionic copolymer of acrylamide with sodium acrylate (65/35) (wt./wt.) with 300 ppm by weight methylene bis acrylamide prepared by microemulsion polymerisation as given herein, then made up in water as a 0.1% polymer concentration.

Bentonite=A commercially available bentonite clay—made up as a 0.1% solids by weight aqueous suspension using deionised water.

The single component systems are evaluated by adding the ADDITIVE at the stated dose t o 500 ml of the paper stock suspension in a 500 ml measuring cylinder and mix ed by 5 hand inversions before being transferred to the DDJ with the stirrer set at 1000 rpm. The tap was opened after 5 seconds and then closed after a further 15 seconds. 250 ml of filtrate is collected for each test.

The dual component systems were evaluated by adding the CATIONIC POLYMER at a dose of 250 grams per tonne to the stock in a measuring cylinder and mixing by five hand inversions. The flocculated stock is then transferred to a shear pot and mixed for 30 seconds with a Heidolph stirrer at a speed of 1500 rpm. The sheared stock was then returned to the measuring cylinder before being dosed with the required amount of anionic component. The re-flocculated suspension was transferred to the DDJ with the stirrer set at 1000 rpm and the filtrate was collected in the same way as specified above.

The three component system are evaluated in the same way as the dual component systems except that the ORGANIC MICROPARTICLE is added immediately after the BENTONITE addition and then mixed by hand inversions.

The blank (no chemical addition) retention value is also determined. For the blank retention, the stock is added to the DDJ, with the stirrer set at 1000 rpm, and the filtrate is collected as above.

A Schopper-Riegler free drainage survey is carried out using the same flocculation systems as described in the method for the retention survey.

First Pass Retention

All retention values shown are percentages

The blank retention is 65.1%

Single Addition Test

TABLE 1

| Dose Level (g/t) | ORGANIC MICROPARTICLE |
|---|---|
| 125 | 61.7 |
| 250 | 63.7 |
| 500 | 66.2 |
| 750 | 66.9 |

Dual Component

CATIONIC POLYMER used at 250 g/t

TABLE 2

| Dose Level (g/t) | ORGANIC-MICROPARTICLE | BENTONITE |
|---|---|---|
| 0 | 62.7 | 62.7 |
| 125 | 71.5 | 64.1 |
| 250 | 74.5 | 66.8 |
| 500 | 76.2 | 70.8 |
| 750 | 78.9 | 72.5 |

Three Component System

CATIONIC POLYMER used at 250 g/t

BENTONITE used at 500 g/t

TABLE 3

| Dose Level (g/t) | ORGANIC-MICROPARTICLE |
|---|---|
| 0 | 70.8 |
| 125 | 78.8 |
| 250 | 82.0 |
| 500 | 84.7 |
| 750 | 84.5 |

The results of table 3 show the benefits of using both siliceous material and organic microparticle.

Filer Retention

All retention values shown are percentages

The blank filler retention is 31.3%

Single Addition Test

TABLE 4

| Dose Level (g/t) | ORGANIC MICROPARTICLE |
|---|---|
| 125 | 23.7 |
| 250 | 29.1 |
| 500 | 36.1 |
| 750 | 36.6 |

Dual Component

CATIONIC POLYMER used at 250 g/t

TABLE 5

| Dose Level (g/t) | ORGANIC-MICROPARTICLE | BENTONITE |
|---|---|---|
| 0 | 26.7 | 26.7 |
| 125 | 45.7 | 29.1 |
| 250 | 51.5 | 35.6 |
| 500 | 55.3 | 43.2 |
| 750 | 60.8 | 46.6 |

Three Component System

CATIONIC POLYMER used at 250 g/t

BENTONITE used at 500 g/t

TABLE 6

| Dose Level (g/t) | ORGANIC-MICROPARTICLE |
|---|---|
| 0 | 43.2 |
| 125 | 60.2 |
| 250 | 66.9 |
| 500 | 72.2 |
| 750 | 72.2 |

The results of table 6 show the benefits in terms of filler retention of using both siliceous material and organic microparticle.

Free Drainage

The free drainage results are measured in seconds for 600 ml of filtrate to be collected. The blank free drainage is 104 seconds Single Addition Test

TABLE 7

| Dose Level (g/t) | ORGANIC MICROPARTICLE |
|---|---|
| 125 | 114 |
| 250 | 130 |
| 500 | 156 |
| 750 | 155 |

Dual Component

CATIONIC POLYMER used at 250 g/t

TABLE 8

| Dose Level (g/t) | ORGANIC-MICROPARTICLE | BENTONITE |
|---|---|---|
| 0 | 78 | 78 |
| 125 | 41 | 52 |
| 250 | 39 | 40 |
| 500 | 44 | 31 |
| 750 | 46 | 28 |

Three Component System

CATIONIC POLYMER used at 250 g/t

BENTONITE used at 500 g/t

TABLE 9

| Dose Level (g/t) | ORGANIC-MICROPARTICLE |
|---|---|
| 0 | 31 |
| 125 | 23 |
| 250 | 21 |
| 500 | 20 |
| 750 | 23 |

The results of table 9 show the benefits of using both siliceous material and organic microparticle.

EXAMPLE 2

The First Pass Retention tests of Example 1 are repeated except using an ORGANIC-MICROPARTICLE that has been prepared using 1000 ppm by weight methylene-bis-acrylamide.

First Pass Retention

All retention values shown are percentages

The blank retention is 82.6%

Single Addition Test

TABLE 10

| Dose Level (g/t) | CATIONIC POLYMER |
|---|---|
| 250 | 86.3 |
| 500 | 85.8 |

Dual Component

CATIONIC POLYMER used at 500 g/t

TABLE 11

| Dose Level (g/t) | ORGANIC-MICROPARTICLE | BENTONITE |
|---|---|---|
| 0 | 85.8 | 85.8 |
| 250 | 87.9 | 82.2 |
| 500 | 87.4 | 86.7 |

Three Component System

CATIONIC POLYMER used at 500 g/t

BENTONITE used at 500 g/t

TABLE 12

| Dose Level (g/t) | ORGANIC-MICROPARTICLE |
|---|---|
| 0 | 86.7 |
| 125 | 89.7 |
| 250 | 88.3 |
| 500 | 92.3 |

The results of table 12 show the benefits of using both siliceous material and organic microparticle.

EXAMPLE 3

Laboratory headbox stock was prepared to 0.64% consistency with 50% hardwood fibre and 50% softwood fibre and containing 30% precipitated calcium carbonate (PCC) based on dry fibre.

The additives used are as in Example 1 except that the bentonite is replaced by a commercially available polyaluminosilicate microgel (Particol BX$^{RTM}$)

Single Component

A 500 ml aliquot of stock was treated for each retention test; 1000 ml was treated for free drainage testing. For single component testing, the stock was mixed at 1500 rpm for 20 seconds in a Britt jar fixed with an 80M screen. CATIONIC POLYMER was added and, after an additional 5 seconds of shear at 1000 rpm, 100 ml of whitewater was collected through the jar valve for first pass retention testing.

Two Component System

For the two component systems, CATIONIC POLYMER was added 10 seconds prior to the microparticle addition. Particol BX or Organic microparticle was dosed after 20 seconds of total shear. Whitewater was collected as for single component testing.

Three Component System

The third component was added immediately after the second component for each 3-component system.

First pass ash retention was determined by burning the dry filter pads at 525° C. for 4 hours. Free drainage testing was conducted using a Schopper-Riegler free drainage tester. The stock was mixed at 1000 rpm for a total of 30 seconds for each test. Retention aids were added in the same time intervals as retention testing.

System Components and Dosages

Figure 2:
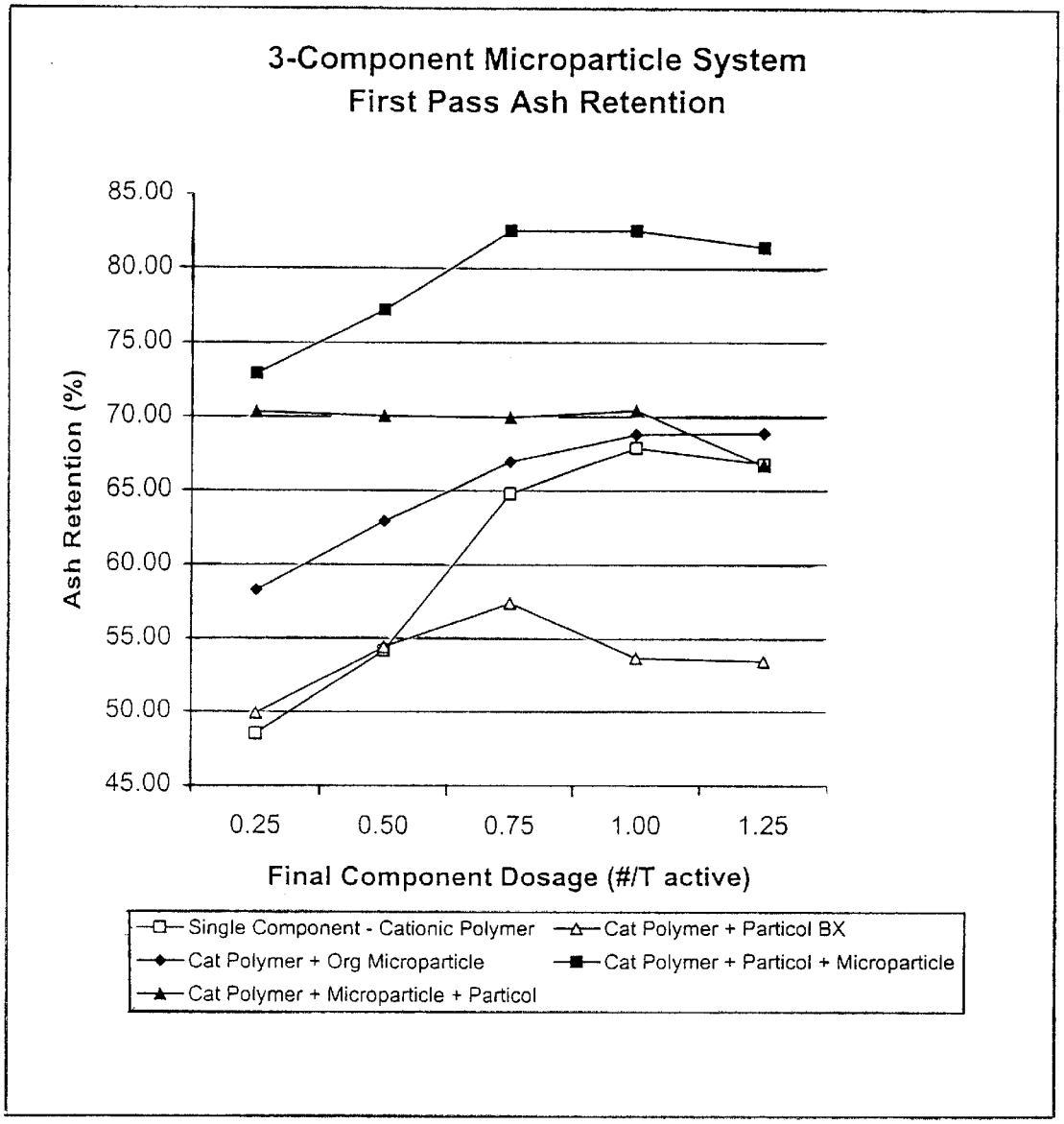
FIG. 2 is a graph showing ash retention versus dosage for various systems.
Figure 3:
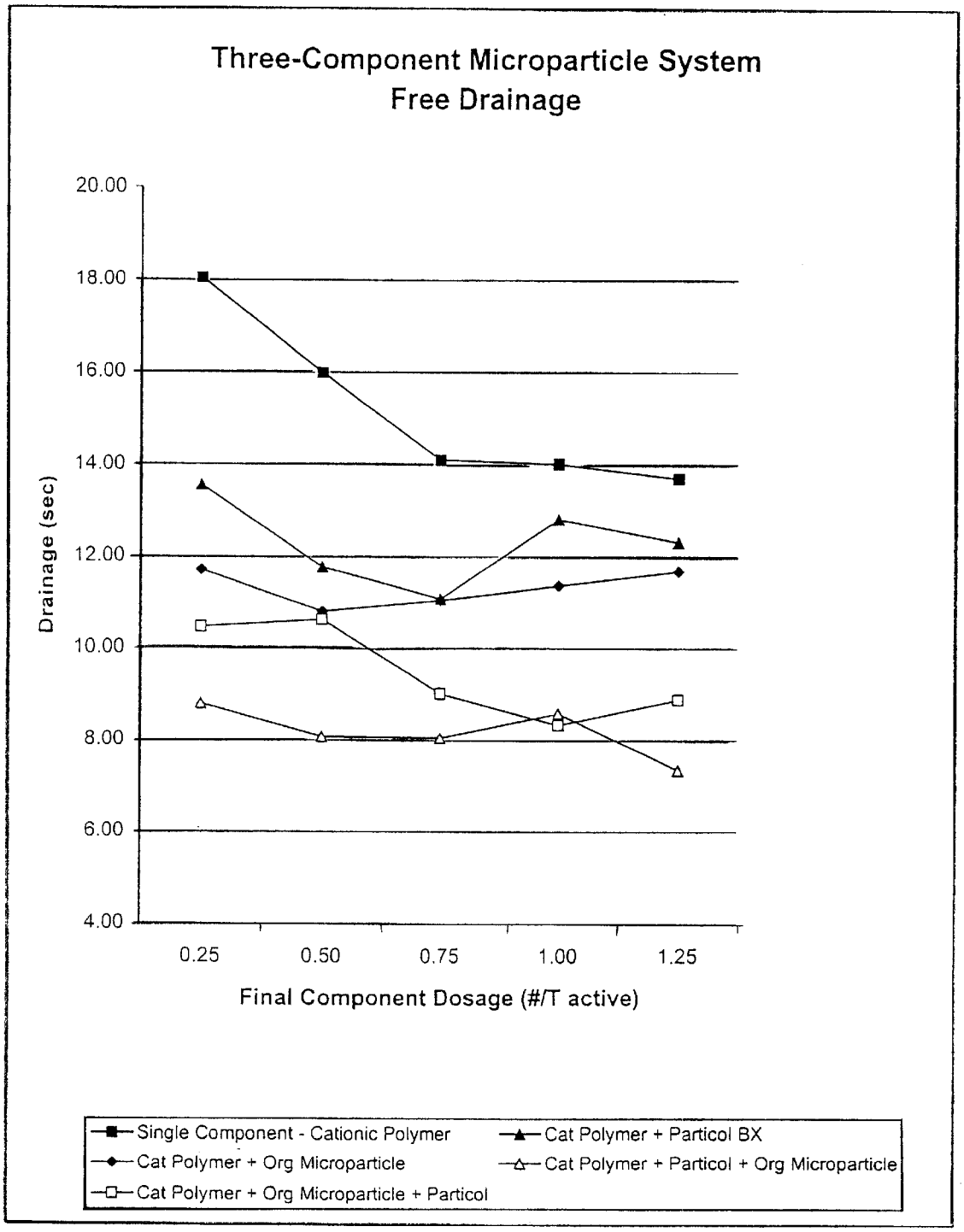
FIG. 3 is a graph showing drainage versus dosage for various systems.

The single component cationic flocculant was dosed at 0.25, 0.5, 0.75, 1 and 1.25 pounds per ton active. A fixed flocculant dosage was then determined from those results for use in the two- and three-component systems. Each additional component was dosed at 0.25, 0.5, 0.75, 1 and 1.25 pounds per ton active. The second components were fixed at 0.75 pounds per ton active for the three-component systems. The results are shown in FIGS. 1 through 3.

First Pass Retention

FIG. 1 shows the first pass retention performance of the various systems. The components used for each system are listed in the legend with the final component dosage used as the x-axis. FIG. 1 shows that the highest advantage in first pass retention can be achieved by adding organic microparticle as the final component in the three-component system with microgel Particol BX.

First Pass Ash Retention

Similar trends in first pass ash retention performance are shown in FIG. 2 for the same systems used with Particol BX. The advantage in ash retention is demonstrated by the addition of Organic microparticle to the Particol system.

Free Drainage

FIG. 3 shows the free drainage performance of the microparticle systems tested.

Example 3 demonstrates the improvements over the two component systems using cationic polymer a polysilicate microgel and organic microparticle over the two component systems using cationic polymer and either organic microparticle or polysilicate microgel.

What is claimed is:

1. A process for making paper or paper board comprising forming a cellulosic suspension, flocculating the suspension, draining the suspension on a screen to form a sheet and then drying the sheet, wherein the suspension is flocculated by adding a flocculation system comprising a siliceous material and organic polymeric microparticles which have an unswollen particle diameter of less than 750 nanometers, in which the total charge in the organic polymeric microparticle is greater that about 1%, and in which the siliceous material is selected from the group consisting of silica sols, colloidal silica, colloidal silicic acid, polysilicic microgels, aluminated polysilicic acid, polyaluminosilicates consisting of silicic microparticles, silica microgels, polyparticulate polysilicic microgels, colloidal borosilicate, polyborosilicates, cationic silica and swellable clay, wherein the flocculating system comprises, i) adding up to 400 ppm by weight organic polymeric microparticle and at least 500 ppm by weight of siliceous material, or ii) the organic polymeric microparticle and siliceous material is added as a premixed composition.

2. A process according to claim 1 in which the microparticles exhibit a solution viscosity of at least 1.1 mPa.s and a cross-linking agent content of above 4 molar ppm based on monomeric units.

3. A process according to claim 1 in which the microparticles have an ionicity of at least 5.0%.

4. A process according to claim 1 in which the microparticles are microbeads which have a particle size of less than 750 nanometers if cross-linked and less than 60 nanometers if non-cross-linked and water-insoluble.

5. A process according to claim 1 in which the microparticles exhibit a rheological oscillation value of tan delta at 0.005 Hz of below 0.7 based on 1.5% by weight polymer concentration in water.

6. A process according to claims 5 in which the tan delta value is below 0.5.

7. A process according to claim 1 in which the siliceous material is an anionic microparticulate material.

8. A process according to claim 1 in which the siliceous material is a bentonite type clay.

9. A process according to claim 1 in which the siliceous material is selected from the group consisting of hectorite, smectites, montmorillonites, nontronites, saponite, sauconite, hormites, attapulgites and sepiolites.

10. A process according to claim 1 in which the components of the flocculation system are introduced into the cellulosic suspension sequentially.

11. A process according to claim 1 in which the siliceous material is introduced into the suspension and then the polymeric microparticle is included in the suspension.

12. A process according to claim 1 in which the polymeric microparticle is introduced into the suspension and then the siliceous material is included in the suspension.

13. A process according to claim 1 in which the cellulosic suspension is treated by inclusion of a further flocculating material into the suspension prior to introducing the polymeric microparticle and siliceous material.

14. A process according to claim 13 in which the further flocculating material is a cationic material selected from the group consisting of water soluble cationic organic polymers, inorganic materials such as alum, polyaluminium chloride, aluminium chloride trihydrate and aluminium chloro hydrate.

15. A process according to claim 1 in which the flocculating system additionally comprises at least one additional flocculant/coagulant.

16. A process according to claim 15 in which the flocculant/coagulant is a water soluble polymer.

17. A process according to claim 14 in which the cationic polymer is formed from a water soluble ethylenically unsaturated monomer or water soluble blend of ethylenically unsaturated monomers comprising at least one cationic monomer.

18. A process according to claim 14 in which the cationic polymer is a branched cationic polymer which has an intrinsic viscosity above 3 dl/g and exhibits a rheological oscillation value of tan delta at 0.005 Hz of above 0.7.

19. A process according to claim 14 in which the cationic polymer has an intrinsic viscosity above 3 dl/g and exhibits a rheological oscillation value of tan delta at 0.005 Hz of above 1.1.

20. A process according to claim 1 in which the suspension is subjected to mechanical shear following the addition of at least one of the components of the flocculating system.

21. A process according to claim 1 in which the suspension is first flocculated by introducing the cationic polymer, optionally subjecting the suspension to mechanical shear and then reflocculating the suspension by introducing the polymeric microparticle and siliceous material.

22. A process according to claim 1 in which the cellulosic suspension is reflocculated by introducing the siliceous material and then the polymeric microparticle.

23. A process according to claim 22 in which the cellulosic suspension is reflocculated by introducing the polymeric microparticle and then the siliceous material.

24. A process according to claim 1 in which the cellulosic suspension comprises filler.

25. A process according to claim 24 in which the cellulosic suspension comprises filler in an amount up to 40% by weight based on dry weight of suspension.

26. A process according to claim 24 in which the filler material is selected from precipitated calcium carbonate, ground calcium carbonate, clay and titanium dioxide.

27. A process according to claim 1 in which the cellulosic suspension is substantially free of filler.

* * * * *